US009404290B2

(12) United States Patent
Leyden

(10) Patent No.: US 9,404,290 B2
(45) Date of Patent: Aug. 2, 2016

(54) SECURABLE ARTICLE DISPLAY

(71) Applicant: Se-Kure Controls, Inc., Franklin Park, IL (US)

(72) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 366 days.

(21) Appl. No.: 14/109,282

(22) Filed: Dec. 17, 2013

(65) Prior Publication Data

US 2015/0167356 A1 Jun. 18, 2015

(51) Int. Cl.

| | |
|---|---|
| ***E05B 73/00*** | (2006.01) |
| ***A47F 5/08*** | (2006.01) |
| ***A47F 7/024*** | (2006.01) |
| ***A47F 3/00*** | (2006.01) |

(52) U.S. Cl.

CPC ..... *E05B 73/0017* (2013.01); *A47F 3/002* (2013.01); *A47F 5/0861* (2013.01); *A47F 5/0876* (2013.01); *A47F 7/024* (2013.01)

(58) Field of Classification Search

CPC ... E05B 73/0017; E05B 73/00; E05B 69/006; B25H 3/04; B25H 3/06; A47F 5/0861; A47F 5/0876; A47F 5/0006; A47F 5/08; A47F 5/0807; A47F 3/002; A47F 7/024; A47F 7/0246; A47F 5/823; A47F 1/128

USPC ..... 211/4, 7, 57.1, 59.1; 70/57.1, 58–62

See application file for complete search history.

(56) References Cited

U.S. PATENT DOCUMENTS 2,046,815 A * 7/1936 Fike ..... E05B 73/00 70/61
4,155,458 A * 5/1979 Moline ..... B25H 3/04 211/4
4,211,455 A * 7/1980 Tedrow ..... B25H 3/02 206/373
4,406,372 A * 9/1983 Bell ..... A47F 7/024 206/493
5,160,048 A * 11/1992 Leyden ..... A47F 7/24 211/7
5,265,950 A * 11/1993 Atkinson ..... A47B 81/005 211/64
5,520,291 A * 5/1996 Graham ..... A47B 81/005 211/4
6,427,497 B1 * 8/2002 Mossberg, Jr. ..... A47B 81/005 211/4
6,474,478 B1 * 11/2002 Huehner ..... A47F 5/0861 211/4
6,767,234 B1 * 7/2004 Rosa ..... A47F 5/0823 211/1.55

(Continued)

*Primary Examiner* — Jennifer E Novosad

(74) *Attorney, Agent, or Firm* — Wood, Phillips, Katz, Clark & Mortimer

(57) ABSTRACT

A securable article display having a main base fixedly mounted upon a support and a first elongate hanger projecting therefrom. A blocking system has a U-shaped component with a base portion and spaced first and second legs. The U-shaped component is movable relative to the main base between: a) a first position wherein a portion of the first elongate hanger resides between the first and second legs to prevent separation of an article; and b) a second position wherein an article can be separated. The portion of the first elongate hanger moves through a slot as the U-shaped component is changed between the first and second positions. A locking system includes a blocking assembly that is changeable between: a) a locked state wherein the blocking assembly blocks the slot with the U-shaped component in its first position; and b) an unlocked state wherein the portion of the first elongate hanger is allowed to move through the slot.

19 Claims, 6 Drawing Sheets

(56) References Cited

U.S. PATENT DOCUMENTS 6,799,523 B1 * 10/2004 Cunha ..... A47F 5/0093 108/108
7,104,094 B2 * 9/2006 Zadak ..... A47F 5/0861 211/4
7,628,281 B2 * 12/2009 Sopel ..... B60P 7/15 211/7
7,703,308 B2 * 4/2010 Nagelski ..... A47F 5/0861 211/54.1
D660,604 S * 5/2012 Barnett ..... D6/323
8,800,785 B2 * 8/2014 Kalafut ..... A47F 5/0861 211/103
2004/0262247 A1 * 12/2004 Moon ..... A47F 7/28 211/74
2009/0184130 A1 * 7/2009 Miller ..... A47F 1/126 221/279
2011/0220597 A1 * 9/2011 Sherretts ..... A47F 1/126 211/59.3
2012/0285911 A1 * 11/2012 Valiulis ..... A47F 5/0861 211/59.2
2015/0167356 A1 * 6/2015 Leyden ..... E05B 73/0017 223/85

* cited by examiner 12
58
56
10
28
18
L
20
116
24
60
120
26
108
114
22
114
104
68
64
66
118
100
110
52
74
106
102
96
94
98
59
62
70
112
88
80
124
42
52
44
72
60
92
84
76
82
86
122
78

SECURABLE ARTICLE DISPLAY

BACKGROUND OF THE INVENTION

1. Field of the Invention

This invention relates to article displays and, more particularly, to an article display having a cantilever-mounted, elongate hanger that extends through an article and/or packaging therefor to suspend the article for display.

2. Background Art

A multitude of different configurations of securable article displays are currently in use in retail establishments worldwide. One form of display utilizes a cantilever-mounted, elongate hanger upon which articles are serially placed for display. The elongate hanger has a free end that can be directed through a fully surrounded opening on either the particular article and/or on packaging therefor. Once the articles are placed in a display state, the free end of the elongate hanger is blocked with one or more lockable components that prevent unauthorized separation of the articles from the display.

As theft of even relatively inexpensive items becomes more rampant, retail business owners are faced with either projecting potentially significant losses or taking steps to minimize loss. The latter approach involves an analysis that requires balancing a number of different factors.

First of all, the investment in the security system must be warranted by the anticipated thefts that would occur in the absence thereof. Accordingly, with relatively inexpensive items, the security systems generally must be inexpensive. At the same time, such inexpensive systems are not feasible if they are not effective in terms of preventing theft and capable of being readily and consistently set up by store personnel at sites where they are used.

If a security system is prone to breaking or malfunctioning, its use is not practical. Further, if store personnel cannot easily set up the security systems on such displays and release articles for customer inspection, there is a temptation on the part of store personnel to bypass the security systems. Thus, the investment in the securable display system may have a limited return.

The industry continues to seek out better and more practical security system designs that are affordable, functionally reliable and effective, and capable of being easily operated by store personnel so that they will be consistently used in their intended manner.

SUMMARY OF THE INVENTION

In one form, the invention is directed to a securable article display with a main base fixedly mounted upon a support, with the article display operatively positioned, and a first elongate hanger projecting in cantilever fashion from the main base. The first elongate hanger has a length between the main base and a free end. The length of the first elongate hanger extends substantially in a horizontal line with the article display operatively positioned. The first elongate hanger is configured so that the free end is directed through a fully surrounded opening in an article, or packaging for an article, to place the article in a display state suspended from the first elongate hanger. A blocking system has a U-shaped component with a base portion and spaced first and second legs projecting away from the base portion. The first leg on the U-shaped component has a slot. The U-shaped component is movable relative to the main base between: a) a first position wherein a portion of the first elongate hanger resides between the first and second legs and the horizontal line extends through the base portion so that the U-shaped component prevents separation of an article in the display state by movement of the article towards the free end of the first elongate hanger; and b) a second position wherein the portion of the first elongate hanger does not reside between the first and second legs so that an article in the display state can be separated from the first elongate hanger by being moved along the length of the first elongate hanger up to and past the free end of the first elongate hanger. The portion of the first elongate hanger moves through the slot as the U-shaped component is changed between the first and second positions. The securable article display further has a locking system with a blocking assembly that is changeable between: a) a locked state wherein the blocking assembly blocks movement of the portion of the first elongate hanger through the slot with the U-shaped component in its first position; and b) an unlocked state wherein the portion of the first elongate hanger is allowed to move through the slot to allow the U-shaped component to move from its first position into its second position. The locking system further includes an actuator to change the state of the blocking assembly. The actuator is provided on the base portion of the U-shaped component.

In one form, the actuator is operated through a removable key that is inserted into an operative position at the base portion.

In one form, the blocking assembly has a blocking component that translates in a horizontal path as the blocking assembly is changed between its locked and unlocked states.

In one form, the actuator has a cam component that moves the blocking component as the actuator changes the state of the blocking assembly.

In one form, the cam component is turned around a horizontal axis as the actuator changes the state of the blocking assembly.

In one form, the blocking component has facing wall surfaces between which the cam component resides and against which the cam component acts as the actuator changes the state of the blocking assembly.

In one form, the horizontal axis extends through the base portion.

In one form, the securable article display is provided in combination with a belt having a buckle. The belt is in the display state with the first elongate hanger projecting through an opening that is fully surrounded by the belt buckle.

In one form, there is a second elongate hanger that projects from the main base and cooperates with the blocking assembly in the same way that the first elongate hanger cooperates with the blocking assembly.

In one form, the blocking component is in the form of a strip. At least one of the facing wall surfaces is defined by an L-shaped piece that is attached to the strip.

In one form, the actuator for the blocking assembly is a keyed tumbler that is mounted on the base portion.

In one form, the U-shaped component is changed between its first and second positions by pivoting movement around an axis.

In one form, the U-shaped component is connected directly to the base.

In one form, the blocking component is in the form of an elongate strip with a length. The elongate strip has a flat body with a central plane. The flat body has a bent edge that projects transversely to the central plane and extends along the length of the strip to reinforce the flat body.

In one form, the bent edge extends to adjacent at least one of the facing wall surfaces.

In one form, the invention is directed to a securable article display with a main base fixedly mounted upon a support, with the article display operatively positioned, and a first elongate hanger projecting in cantilever fashion from the main base. The first elongate hanger has a length between the main base and a free end. The length of the first elongate hanger extends substantially in a horizontal line with the article display operatively positioned. The first elongate hanger is configured so that the free end is directed through a fully surrounded opening in an article, or packaging for an article, to place the article in a display state suspended from the first elongate hanger. The securable article display further includes a blocking system with a U-shaped component. The U-shaped component has a base portion and spaced first and second legs which project away from the base portion. The first leg on the U-shaped component has a slot. The U-shaped component is movable relative to the main base between: a) a first position wherein a portion of the first elongate hanger resides between the first and second legs and the horizontal line extends through the base portion so that the U-shaped component prevents separation of an article in the display state by movement of the article towards the free end of the first elongate hanger; and b) a second position wherein the portion of the first elongate hanger does not reside between the first and second legs so that an article in the display state can be separated from the first elongate hanger by being moved along the length of the first elongate hanger up to and past the free end of the first elongate hanger. The portion of the first elongate hanger moves through the slot as the U-shaped component is changed between the first and second positions. The securable article display further has a locking system with a blocking assembly that is changeable between: a) a locked state wherein the blocking assembly blocks movement of the portion of the first elongate hanger through the slot with the U-shaped component in its first position; and b) an unlocked state wherein the portion of the first elongate hanger is allowed to move through the slot to allow the U-shaped component to move from its first position into its second position. The locking system further includes an actuator to change the state of the locking assembly. The actuator is a cam component that is turned around a horizontal axis to change the blocking assembly between the locked and unlocked states.

In one form, the blocking assembly has a blocking component that translates in a horizontal path as the blocking assembly is changed between its locked and unlocked states. The blocking component has facing wall surfaces between which the cam component resides and against which the cam component acts as the actuator changes the state of the blocking assembly.

In one form, the blocking component is in the form of an elongate strip with a length. The elongate strip has a flat body with a central plane. The flat body has a bent edge which projects transversely to the central plane and extends along the length of the strip to reinforce the flat body.

In one form, the bent edge extends to adjacent at least one of the facing wall surfaces.

DETAILED DESCRIPTION OF THE PREFERRED EMBODIMENT

Figure 1:
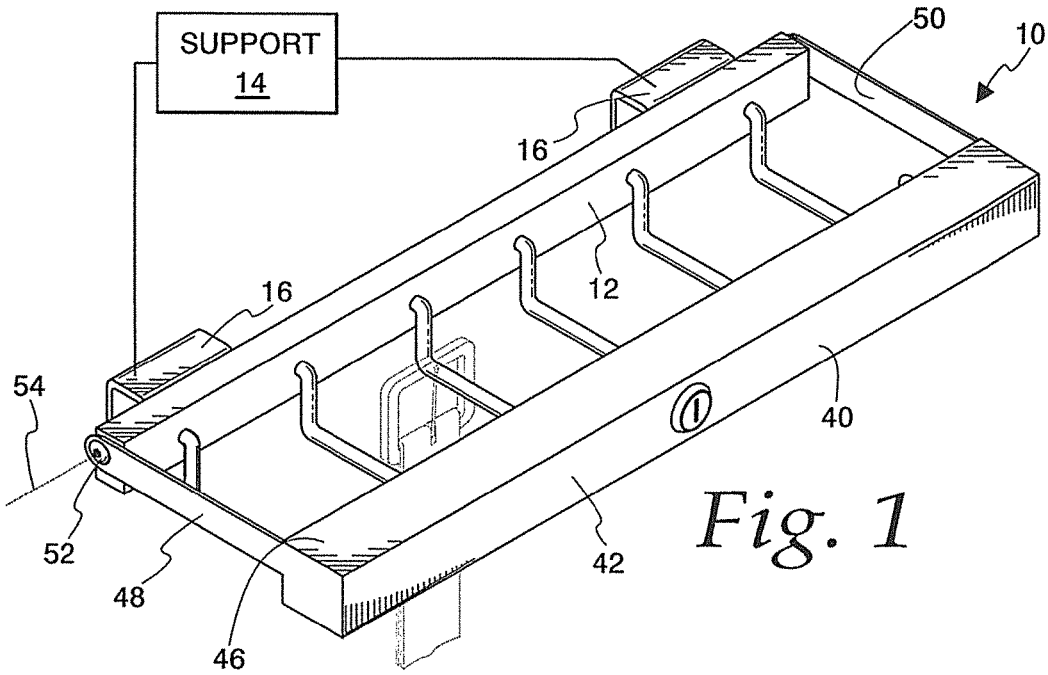
FIG. 1 is a perspective view of a securable article display, according to the present invention, and with a component on a blocking system in a first position to confine articles in a display state.

In FIGS. 1-6, one form of securable article display, according to the present invention, is shown at 10. The article display 10 consists of a main base 12 fixedly mounted upon a support 14 with the article display operatively positioned. In this embodiment, the support 14 is shown schematically to encompass virtually any type of structure to which the main base 12 might be stably mounted. In this embodiment, the main base 12 has a pair of spaced brackets 16 suitably connected to the support 14.

A plurality of elongate hangers 18 project in cantilever fashion from the main base 12. The elongate hangers 18 have the same configuration, however this is not necessary. Each elongate hanger 18 has a length L between the main base 12 and a free end 20.

Figure 2:
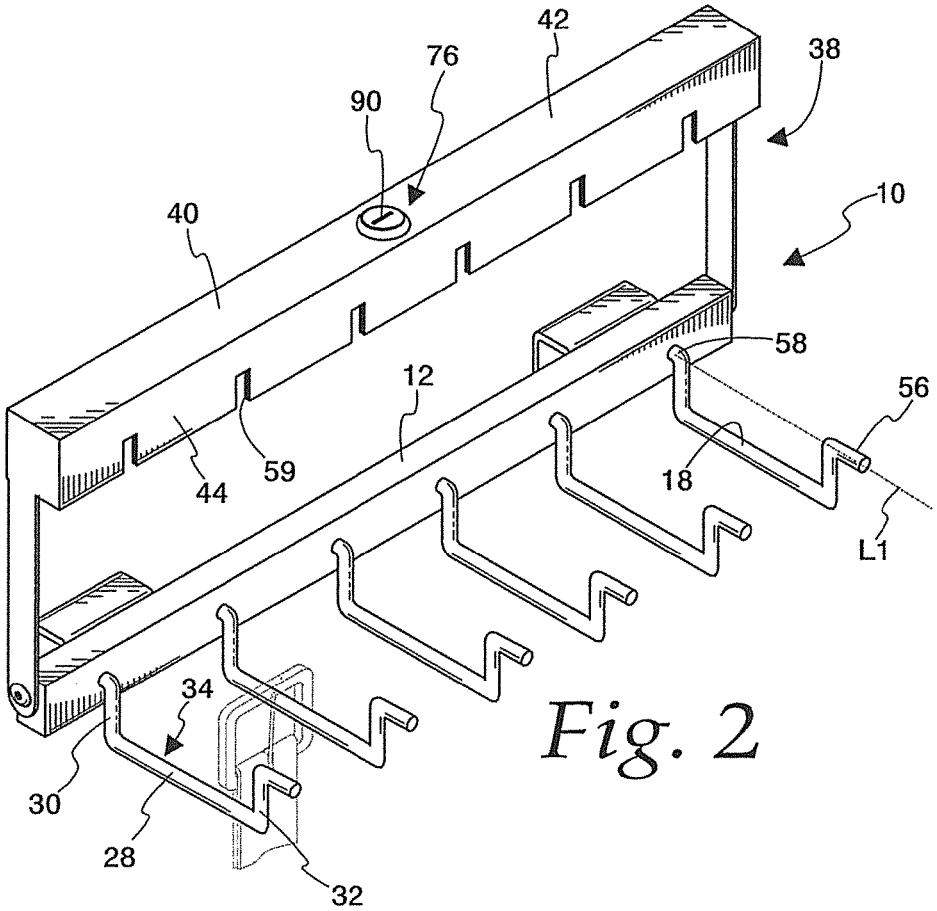
FIG. 2 is a view as in FIG. 1 wherein the blocking system component has been changed to a second position wherein articles can be loaded onto and separated from the display.

In this embodiment, each of the elongate hangers 18 has an upwardly opening U-shape. Each elongate hanger 18 is configured to support a plurality of articles to be displayed. In the figures, an exemplary displayed article is in the form of a belt 22 having a buckle 24 that defines a fully surrounded opening 26. To place the article/belt 22 in a display state, as shown in FIGS. 1 and 2, the free end 20 of an elongate hanger 18 is directed through the opening 26 in the article/belt 22 that is thereafter slid guidingly along a straight length 28 of the elongate hanger 18 rearwardly towards the main base 12. The article/belt 22 is thus suspended on the elongate hanger 18 by the buckle 24 for display. A number of the articles 22 can be placed in a display state upon the elongate hanger 18 by serially placing them in the display state in the same manner.

The straight length 28 defines the usable display portion of the elongate hanger 18. By making the elongate hangers 18 with the "U" shape, defined by spaced vertically extending legs 30, 32 projecting away from the straight length 28, a receptacle at 34 is defined for the articles 22 with fore-and-aft movement thereof confined between the legs 30, 32. Thus, the articles 22 do not tend to slide off of the hangers 18.

As an alternative form, the elongate hangers 18 could each be made with a simple straight shape between locations where they depart from the main base 12 and the free ends 20. For purposes of the description hereinbelow, the elongate hangers 18 will be treated as simplified straight components without the built in "U" configuration wherein the lengths L thereof project horizontally with the main base 12 operatively positioned as shown in the figures upon the support 14.

Figure 5:
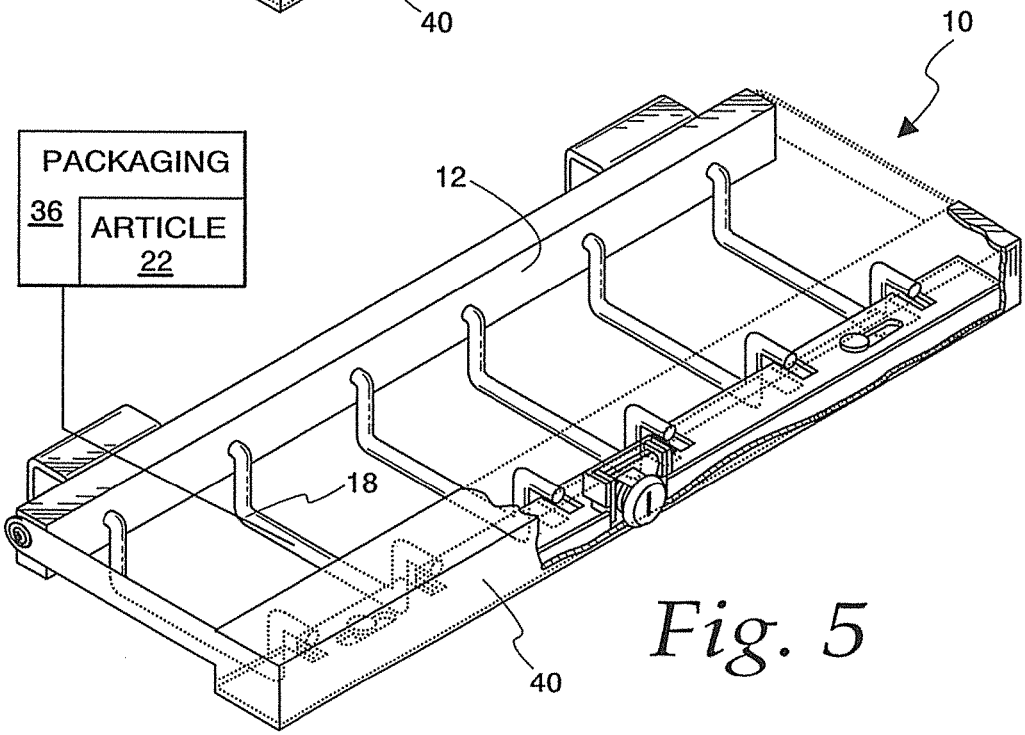
FIG. 5 is a view as in FIG. 4 wherein the blocking assembly is in a locked state.
Figure 7:
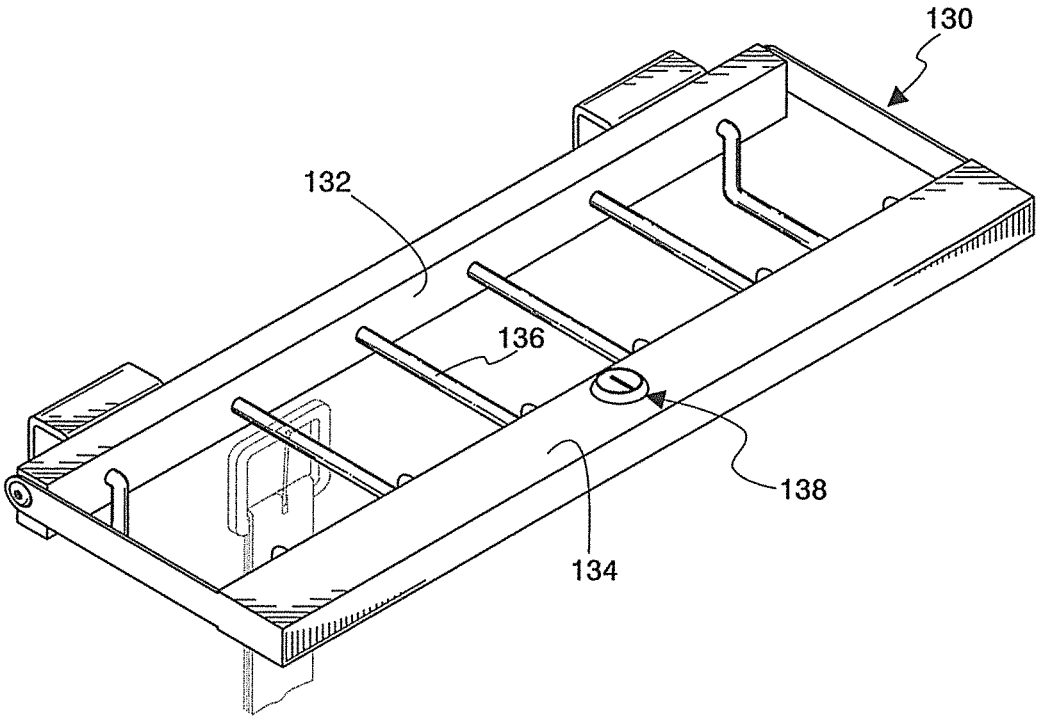
Fig. 7 (Prior Art)
FIG. 7 is a view as in FIG. 1 and showing a prior art securable article display.
Figure 8:
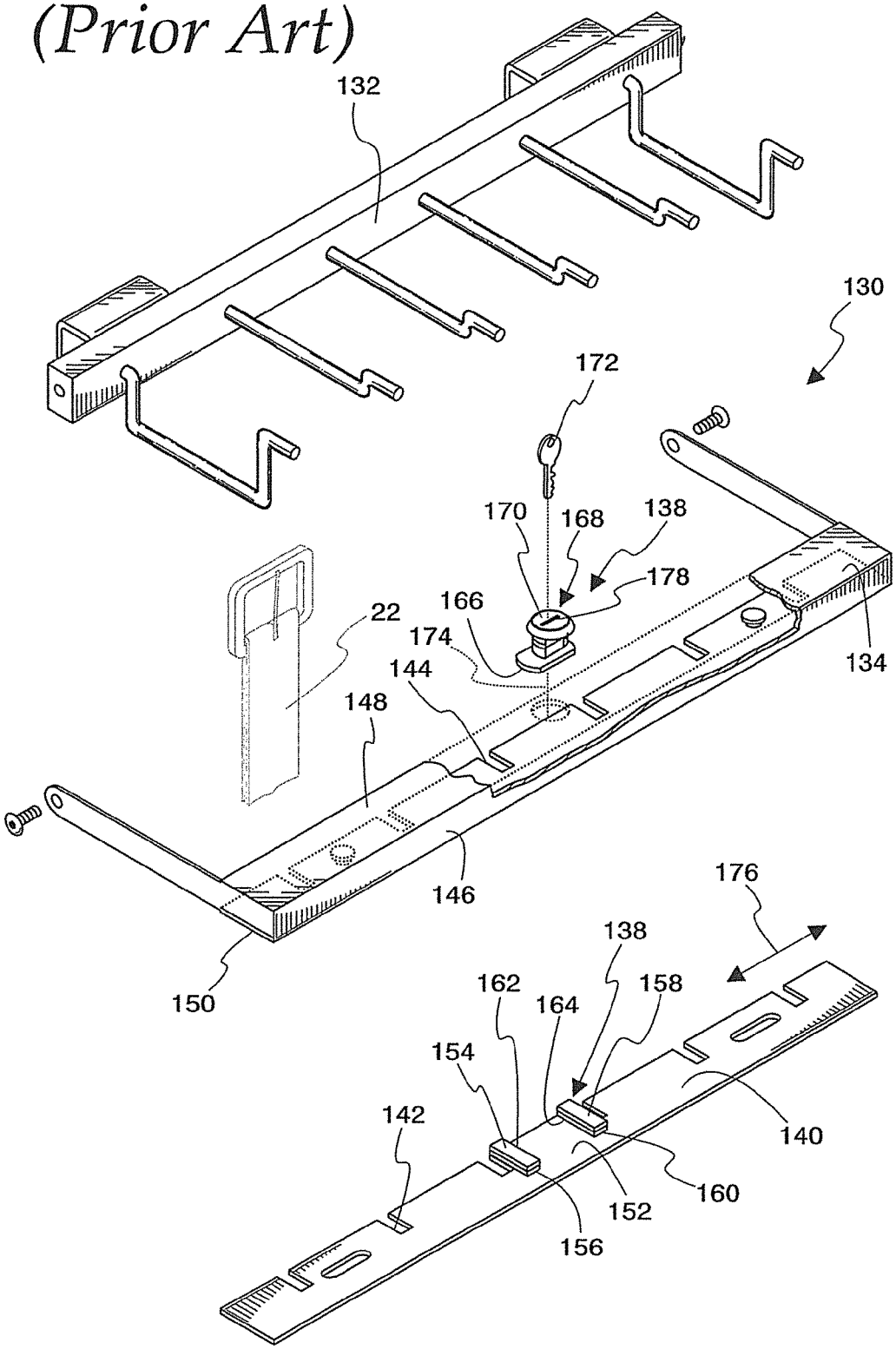
Fig. 8 (Prior Art)
FIG. 8 is an exploded perspective view of the display in FIG. 7.
Figure 9:
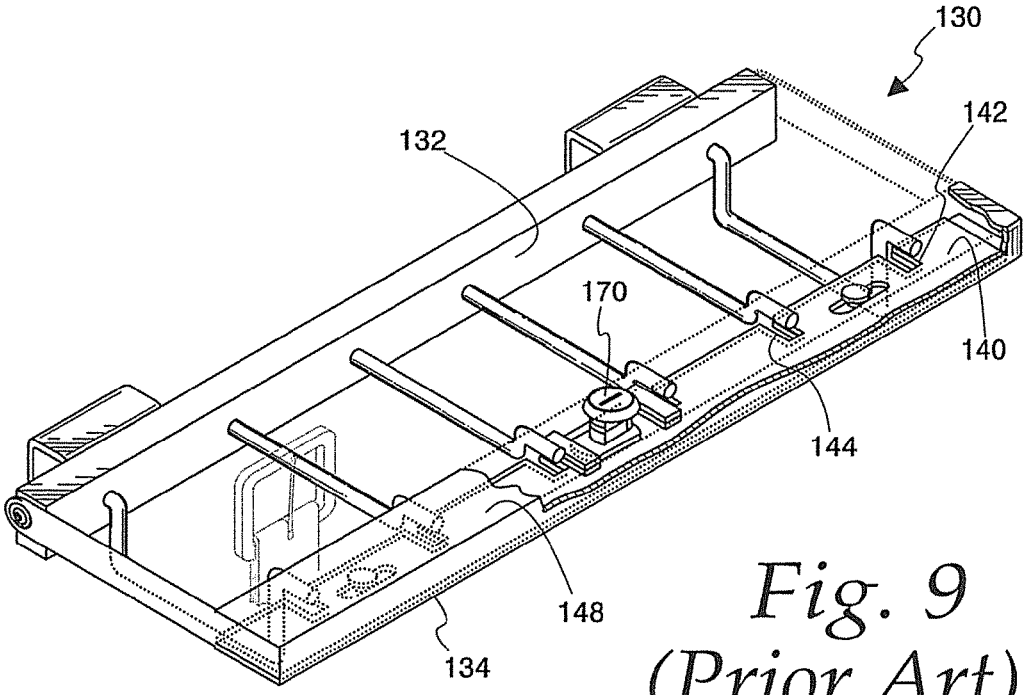
Fig. 9 (Prior Art)
FIG. 9 is a view as in FIG. 7 and showing a blocking assembly on the display in an unlocked state.
Figure 10:
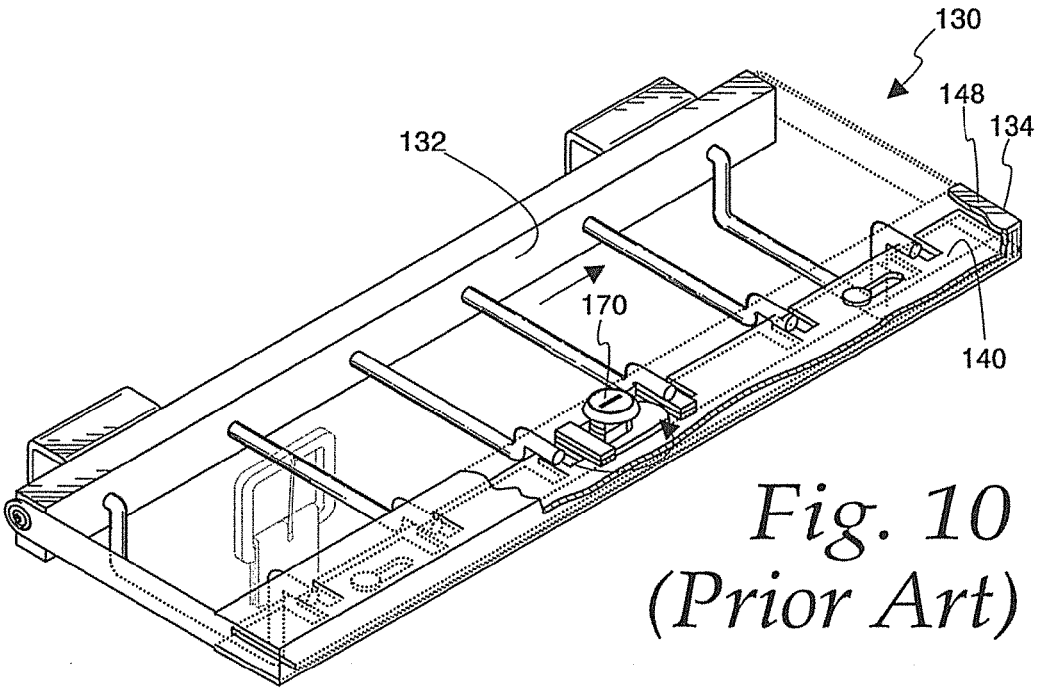
Fig. 10 (Prior Art)
FIG. 10 is a view as in FIG. 9 wherein the blocking assembly is in a locked state.

It should also be understood that articles 22 might be displayed by directing the elongate hangers 18 through a fully surrounded opening in packaging 36 therefor, as shown schematically in FIG. 5.

While a horizontal arrangement for the projecting length L of an elongate hanger 18 is most common, different orientations are contemplated, in which event the relationship between the components as described and claimed herein would be accordingly changed.

To selectively and controllably confine articles 22 in the display state on the various elongate hangers 18, a blocking system at 38 is employed. The blocking system 38 has an elongate component 40 that is "U"-shaped in cross-section as defined by a base portion 42 and spaced first and second legs 44, 46, respectively, projecting away from the base portion 42.

Figure 4:
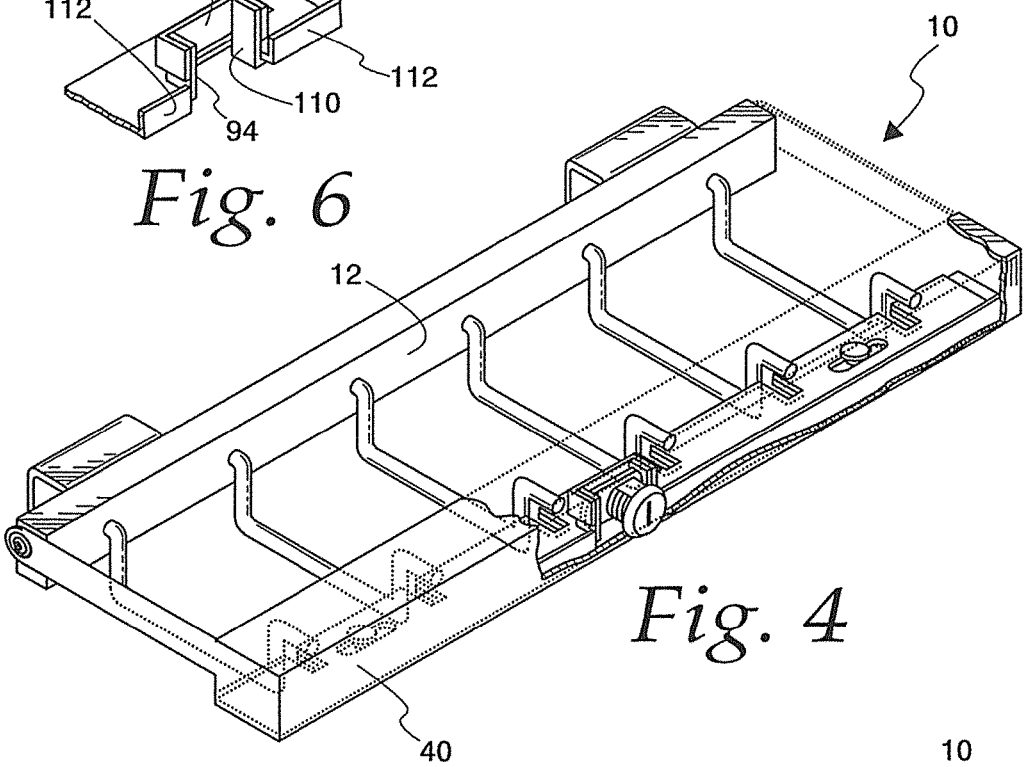
FIG. 4 is a view as in FIG. 1 and showing a locking system with a blocking assembly on the display in an unlocked state.

Spaced arms 48, 50 are fixed at the lengthwise ends of the elongate component 40 and cooperatively straddle the main base 12 and are connected thereto through one or more pivot pins 52. Through the pivot pin(s) 52, the component 40 is guided for pivoting movement relative to the main base 12 around a horizontal axis 54 between a first position, as shown in FIGS. 1, 4, and 5, and a second position, as shown in FIG. 2.

With the component 40 in the first position, a portion 56 of each of the elongate hangers 18 resides between the first and second legs 44, 46 and a horizontal line L1, through the center of each portion 56 and an aligned rear portion 58, that is parallel to the length of the straight lengths 28, extends through the base portion 42. As a result, the "U"-shaped component prevents separation of articles 22 in the display state by movement of the articles towards the free end 20 of the associated elongate hanger 18.

With the "U"-shaped component moved from the first position into the second position, the portion 56 of each elongate hanger 18 does not reside between the first and second legs 44, 46 so that an article 22 in the display state can be separated from its respective elongate hanger 18 by being moved along the length thereof up to and past its free end 20.

To allow movement of the component 40 between its first and second positions, the first leg 44 has a series of slots 59 that align one each with the portions 56 on the elongate hangers 18. As the component 40 moves between the second position into the first position therefor, each of the portions 56 passes through a slot 59 to thereby reside between the first and second legs 44, 46.

To maintain the component 40 in its first position so that articles 22 are blocked in the display state, a locking system 60 is provided. The locking system 60 consists of a blocking assembly 62 that is changeable between locked and unlocked states, shown respectively in FIGS. 5 and 6. In the locked state therefor, the blocking assembly 62 blocks movement of the portions 56 of the elongate hangers 18 through the slots 59. In the unlocked state therefor, the portions 56 of the elongate hangers 18 are allowed to move through the slots 59 to allow the component 40 to move from its first position into its second position.

More specifically, the blocking assembly 62 consists of a blocking component 64 that translates back and forth in a horizontal path, as indicated by the double-headed arrow 66, as the blocking assembly is changed between its locked and unlocked states. The blocking component has a body 68 in the form of a flat strip with one flat surface 70 that facially engages an oppositely facing flat surface 72 on the first leg 44 of the component 40. The body 68 has slots 74 formed therein that are substantially the same in shape and dimension as the slots 59. The slots 74 correspond in number to the slots 59 and are registrable one each with the slots 59 with the blocking assembly 62 in its unlocked state.

With the blocking assembly 62 in its unlocked state, translation of the body 68 in the path indicated by the arrow 66 a slight distance causes the slots 59, 74 to move out of registration with each other. In other words, a solid portion of the body 68 blocks the slots 59 so that the portions 56 are not allowed to pass through the slots 59 with the component 40 in the first position therefor.

The locking system 60 additionally includes an actuator 76 through which the blocking assembly 62 is changed between its locked and unlocked states. The actuator 76 includes a cam component 78 that is repositioned to translate the blocking component 64 in its operating path, as indicated by the double-headed arrow 66. The cam component 78 is repositionable through a tumbler 80 in a cylinder 82. The tumbler 80 is controlled by a key 84 that is directed into the tumbler 80 in a front-to-rear line, as indicated by the arrow 86. The tumbler 80 is turned through the key 84 about a fore-and-aft, horizontal axis 88 that extends through the base portion 42.

With this cylinder location, the tumbler slot 90 for the key 84 is readily visible with the system in the FIG. 1 state, thereby alerting both would-be thieves and store personnel to its presence. The key 84 and tumbler 80 are also situated to be conveniently accessed and operated with this construction.

The cam component has an edge 92 that interacts with facing wall surfaces 94, 96 on the blocking component 64 between which the cam component 78 resides. In this embodiment, each of the wall surfaces 94, 96 is defined on an L-shaped piece 98, 100, respectively. Exemplary piece 98 is made from flat stock with one leg 102 secured to a flat underside surface 104 on the body 68. A transverse leg 106 has the surface 94 defined thereon.

A "U"-shaped reinforcing piece 108 straddles the leg 106 and a corresponding leg 110 on the "L"-shaped piece 100 and is secured, as by welding, to the separate pieces 98, 100.

Figure 3:
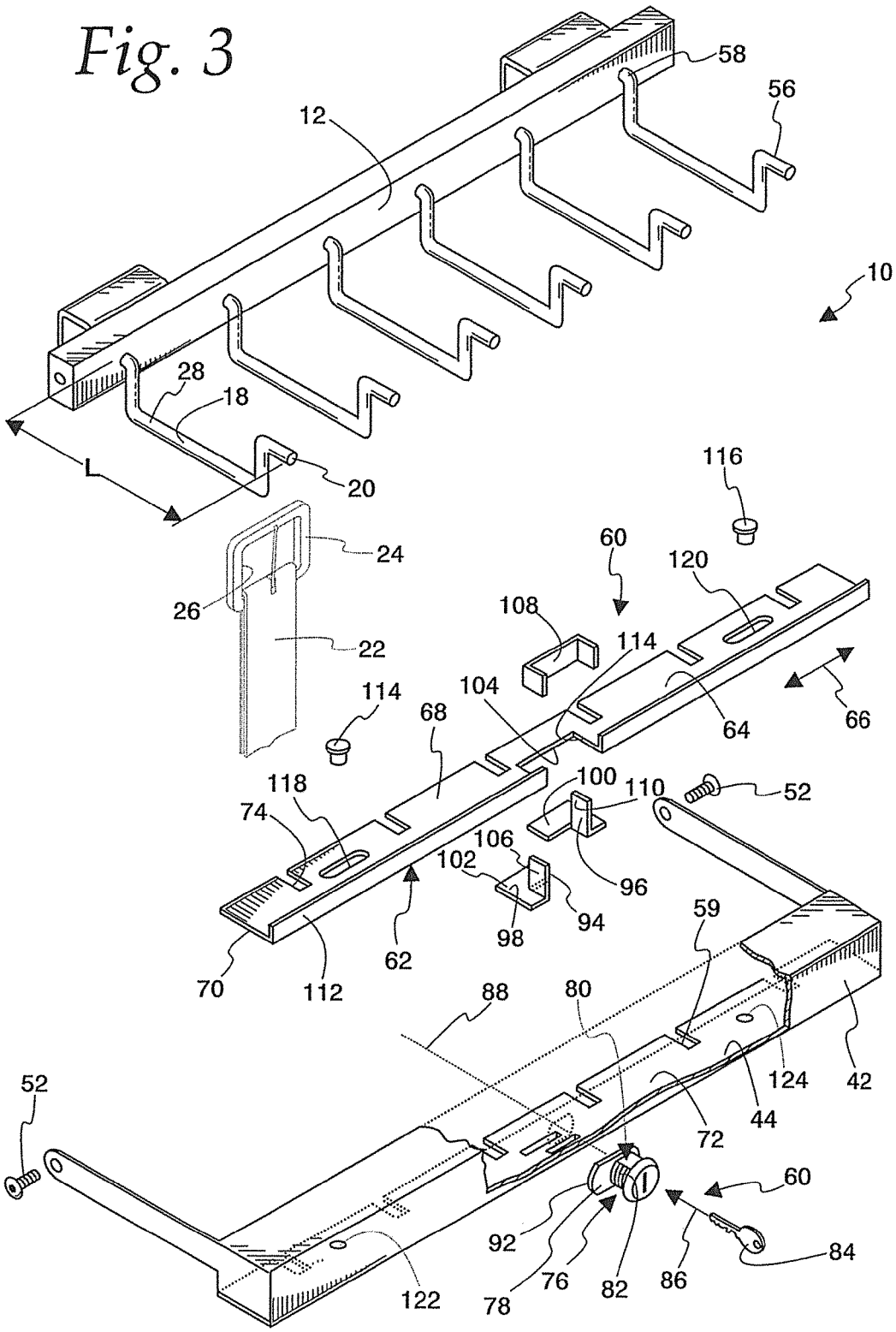
FIG. 3 is an exploded perspective view of the display in FIGS. 1 and 2.
Figure 6:
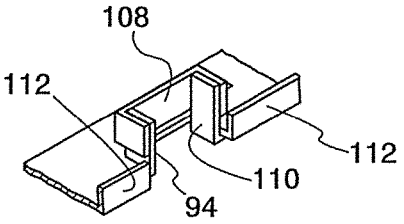
FIG. 6 is an enlarged, fragmentary, perspective view of part of the blocking assembly, that makes up part of the locking system, and that moves as the blocking system is changed between the locked and unlocked states.

Turning of the key 84 in one direction around the axis 88 bears the cam edge 92 against the surface 96 to move the body 68 in its translational path in a left-to-right direction in FIG. 3. Opposite turning of the key 84 shifts the body 68 to move oppositely in translation.

The body 68 has an integrally formed reinforcing edge 112 bent out of the central plane of the flat body 68, in this case at the front edge thereof to project transversely/vertically therefrom. In this embodiment, the edge 112 extends over substantially the full lengthwise extent of the body 68, with the exception of where the body 68 is interrupted by a cutout 114 that accommodates the upwardly projecting legs 106, 110. The bent edge 112 extends to adjacent each of the wall surfaces 94, 96. Accordingly, relatively thin stock can be used for the body 68 but will be adequately rigidified by this construction, as will the associated legs 106, 110.

The body 68 is maintained in its operative position by spaced fasteners 114, 116 that extend through elongate openings 118, 120 respectively and into accommodating openings 122, 124, respectively in the first leg 44. The fasteners 114, 116 abut the ends of their respective openings 118, 120 to limit the back-and-forth movement of the blocking component 64 within its path, as indicated by the double-headed arrow 66.

In FIGS. 7-10, a prior art securable article display is shown at 130. The display 130 has a main base 132, corresponding to the main base 12 in the inventive display 10. The display 130 further has an elongate, "U"-shaped component 134, corresponding to the elongate, "U"-shaped component 40 on the display 10. The component 134 cooperates with elongate hangers 136, projecting from the main base 132, in the same manner that the elongate, "U"-shaped component 40 cooperates with the elongate hangers 18.

The primary difference between the displays 10, 130 resides in the construction of the locking systems shown at 138 on the display 130, corresponding to the locking system 60.

The locking system 138 uses a translating body/flat strip 140, that corresponds in function to the body/flat strip 140 on the display 10. The body/flat strip 140 has slots 142 that can be selectively registered with, and misaligned to block, slots 144 on the "U"-shaped component 134. The body/flat strip 140 moves in a space bounded by a base portion 146 and spaced legs 148, 150, making up the "U"-shaped component 134.

The upper surface 152 of the body/flat strip 140 supports a spaced arrangement of paired blocks 154, 156; 158, 160. The paired blocks 154, 156 and 158, 160 define spaced edges 162, 164, respectively, that interact with a cam component 166 on an actuator 168 that makes up part of the locking system 138.

The actuator 168 has a tumbler 170 that is operated by a key 172 that is advanced into the tumbler 170 downwardly parallel to the tumbler axis 174 to effect operation thereof. By turning the key 172 around the axis 174, the cam component 166 acts alternatively against the edges 162, 164 to translate the body/flat strip 140 back and forth in a path indicated by the double-headed arrow 176.

With long belts or other articles 22, the leg 148, upon which the actuator 168 is mounted, may reside a substantial distance above the floor upon which the articles 22 are displayed. Consequently, the user may be required to blindly seek the location of the slot 178 that accommodates the key 172. The manipulation of the key may be somewhat awkward from this position. Further, the actuator 168 may not be readily visible to store personnel who may overlook the need to effect locking of the display. Still further, would-be thieves may not be aware that the display 130 is locked and may attempt to tamper therewith.

The foregoing disclosure of specific embodiments is intended to be illustrative of the broad concepts comprehended by the invention.

The invention claimed is:

1. A securable article display comprising:

a main base fixedly mounted upon a support with the article display operatively positioned;

a first elongate hanger projecting in cantilever fashion from the main base, the first elongate hanger having a length between the main base and a free end, the length of the first elongate hanger extending substantially in a horizontal line with the article display operatively positioned, the first elongate hanger configured so that the free end is directed through a fully surrounded opening in an article or packaging for an article to place the article in a display state suspended from the first elongate hanger;

a blocking system comprising a U-shaped component, the U-shaped component having a base portion and spaced first and second legs projecting away from the base portion, the first leg on the U-shaped component having a slot, the U-shaped component movable relative to the main base between: a) a first position wherein a portion of the first elongate hanger resides between the first and second legs and the horizontal line extends through the base portion so that the U-shaped component prevents separation of an article in the display state by movement of the article towards the free end of the first elongate hanger; and b) a second position wherein the portion of the first elongate hanger does not reside between the first and second legs so that an article in the display state can be separated from the first elongate hanger by being moved along the length of the first elongate hanger up to and past the free end of the first elongate hanger, the portion of the first elongate hanger moving through the slot as the U-shaped component is changed between the first and second positions; and a locking system comprising a blocking assembly that is changeable between: a) a locked state wherein the blocking assembly blocks movement of the portion of the first elongate hanger through the slot with the U-shaped component in the first position; and b) an unlocked state wherein the portion of the first elongate hanger is allowed to move through the slot to allow the U-shaped component to move from the first position into the second position, the locking system further comprising an actuator to change the blocking assembly between the locked and unlocked states, the actuator provided on the base portion of the U-shaped component.

2. The securable article display according to claim 1 wherein the actuator is operated through a removable key that is inserted into an operative position.

3. The securable article display according to claim 1 wherein the blocking assembly comprises a blocking component that translates in a horizontal path as the blocking assembly is changed between the locked and unlocked states.

4. The securable article display according to claim 3 wherein the actuator comprises a cam component that moves the blocking component as the actuator changes the blocking assembly between the locked and unlocked states.

5. The securable article display according to claim 4 wherein the cam component is turned around a horizontal axis as the actuator changes the blocking assembly between the locked and unlocked states.

6. The securable article display according to claim 5 wherein the blocking component has facing wall surfaces between which the cam component resides and against which the cam component acts as the actuator changes the blocking assembly between the locked and unlocked states.

7. The securable article display according to claim 6 wherein the blocking component comprises a strip and at least one of the facing wall surfaces is defined by an L-shaped piece that is attached to the strip.

8. The securable article display according to claim 6 wherein the blocking component comprises an elongate strip with a length, the elongate strip comprising a flat body with a central plane and the flat body has a bent edge projecting transversely to the central plane and extending along the length of the strip to reinforce the flat body.

9. The securable article display according to claim 8 wherein the bent edge extends to adjacent at least one of the facing wall surfaces.

10. The securable article display according to claim 5 wherein the horizontal axis extends through the base portion.

11. The securable article display according to claim 1 in combination with a belt having a buckle, the belt in the display state with the first elongate hanger projecting through an opening that is fully surrounded by the belt buckle.

12. The securable article display according to claim 1 wherein there is a second elongate hanger that projects from the main base and cooperates with the blocking assembly in the same way that the first elongate hanger cooperates with the blocking assembly.

13. The securable article display according to claim 1 wherein the actuator for the blocking assembly comprises a keyed tumbler that is mounted on the base portion.

14. The securable article display according to claim 1 wherein the U-shaped component is changed between the first and second positions by pivoting movement around an axis.

15. The securable article display according to claim 14 wherein the U-shaped component is connected directly to the base.

16. A securable article display comprising:

a main base fixedly mounted upon a support with the article display operatively positioned;

a first elongate hanger projecting in cantilever fashion from the main base, the first elongate hanger having a length between the main base and a free end, the length of the first elongate hanger extending substantially in a horizontal line with the article display operatively positioned, the first elongate hanger configured so that the free end is directed through a fully surrounded opening in an article or packaging for an article to place the article in a display state suspended from the first elongate hanger;

a blocking system comprising a U-shaped component, the U-shaped component having a base portion and spaced first and second legs projecting away from the base portion, the first leg on the U-shaped component having a slot, the U-shaped component movable relative to the main base between: a) a first position wherein a portion of the first elongate hanger resides between the first and second legs and the horizontal line extends through the base portion so that the U-shaped component prevents separation of an article in the display state by movement of the article towards the free end of the first elongate hanger; and b) a second position wherein the portion of the first elongate hanger does not reside between the first and second legs so that an article in the display state can be separated from the first elongate hanger by being moved along the length of the first elongate hanger up to and past the free end of the first elongate hanger, the portion of the first elongate hanger moving through the slot as the U-shaped component is changed between the first and second positions; and a locking system comprising a blocking assembly that is changeable between: a) a locked state wherein the blocking assembly blocks movement of the portion of the first elongate hanger through the slot with the U-shaped component in the first position; and b) an unlocked state wherein the portion of the first elongate hanger is allowed to move through the slot to allow the U-shaped component to move from the first position into the second position, the locking system further comprising an actuator to change the state of the blocking assembly, the actuator comprising a cam component that is turned around a horizontal axis to change the blocking assembly between the locked and unlocked states.

17. A securable article display comprising:

a main base fixedly mounted upon a support with the article display operatively positioned;

a first elongate hanger projecting in cantilever fashion from the main base, the first elongate hanger having a length between the main base and a free end, the length of the first elongate hanger extending substantially in a horizontal line with the article display operatively positioned, the first elongate hanger configured so that the free end is directed through a fully surrounded opening in an article or packaging for an article to place the article in a display state suspended from the first elongate hanger;

a blocking system comprising a U-shaped component, the U-shaped component having a base portion and spaced first and second legs projecting away from the base portion, the first leg on the U-shaped component having a slot, the U-shaped component movable relative to the main base between: a) a first position wherein a portion of the first elongate hanger resides between the first and second legs and the horizontal line extends through the base portion so that the U-shaped component prevents separation of an article in the display state by movement of the article towards the free end of the first elongate hanger; and b) a second position wherein the portion of the first elongate hanger does not reside between the first and second legs so that an article in the display state can be separated from the first elongate hanger by being moved along the length of the first elongate hanger up to and past the free end of the first elongate hanger, the portion of the first elongate hanger moving through the slot as the U-shaped component is changed between the first and second positions; and a locking system comprising a blocking assembly that is changeable between: a) a locked state wherein the blocking assembly blocks movement of the portion of the first elongate hanger through the slot with the U-shaped component in the first position; and b) an unlocked state wherein the portion of the first elongate hanger is allowed to move through the slot to allow the U-shaped component to move from the first position into the second position, the locking system further comprising an actuator to change the state of the blocking assembly, the actuator comprising a cam component that is turned around a horizontal axis to change the blocking assembly between the locked and unlocked states, wherein the blocking assembly comprises a blocking component that translates in a horizontal path as the blocking assembly is changed between the locked and unlocked states, wherein the blocking component has facing wall surfaces between which the cam component resides and against which the cam component acts as the actuator changes the blocking assembly between the locked and unlocked states.

18. The securable article display according to claim 17 wherein the blocking component comprises an elongate strip with a length, the elongate strip comprising a flat body with a central plane and the flat body has a bent edge projecting transversely to the central plane and extending along the length of the strip to reinforce the flat body.

19. The securable article display according to claim 18 wherein the bent edge extends to adjacent at least one of the facing wall surfaces.

* * * * *